US011624243B2

(12) United States Patent
Araque et al.

(10) Patent No.: US 11,624,243 B2
(45) Date of Patent: Apr. 11, 2023

(54) BASEMENT ROCK HYBRID DRILLING

(71) Applicant: Quaise, Inc., Cambridge, MA (US)

(72) Inventors: Carlos Araque, Dorado, PR (US); Justin Lamb, Arcola, TX (US); Franck Monmont, Cambridge (GB); Hy Phan, Houston, TX (US); Matthew Houde, Somerville, MA (US)

(73) Assignee: Quaise, Inc., Cambridge, MA (US)

( * ) Notice: Subject to any disclaimer, the term of this patent is extended or adjusted under 35 U.S.C. 154(b) by 0 days.

(21) Appl. No.: 17/230,739

(22) Filed: Apr. 14, 2021

(65) Prior Publication Data

US 2022/0136334 A1 May 5, 2022

Related U.S. Application Data

(62) Division of application No. 17/090,410, filed on Nov. 5, 2020, now Pat. No. 11,028,648.

(51) Int. Cl.

| | |
|---|---|
| ***E21B 7/24*** | (2006.01) |
| ***E21B 47/04*** | (2012.01) |
| ***E21B 7/00*** | (2006.01) |
| ***E21B 47/07*** | (2012.01) |

(52) U.S. Cl.

CPC ..... *E21B 7/24* (2013.01); *E21B 7/003* (2013.01); *E21B 47/04* (2013.01); *E21B 47/07* (2020.05)

(58) Field of Classification Search

CPC . E21B 7/24; E21B 7/003; E21B 47/04; E21B 47/07; E21B 21/08; E21B 44/00; E21B 49/003; E21B 7/14

See application file for complete search history.

(56) References Cited

U.S. PATENT DOCUMENTS

| | | | | |
|---|---|---|---|---|
| 4,353,249 | A * | 10/1982 | Lagus | E21B 49/087 73/152.52 |
| 4,419,887 | A | 12/1983 | Gournay | |
| 5,251,286 | A | 10/1993 | Wiener et al. | |
| 6,206,108 | B1 * | 3/2001 | MacDonald | E21B 44/00 175/45 |
| 8,393,410 | B2 | 3/2013 | Woskov et al. | |

(Continued)

FOREIGN PATENT DOCUMENTS

| | | | |
|---|---|---|---|
| CN | 204804691 | U | 11/2015 |
| WO | 2006093492 | A2 | 9/2006 |
| WO | 2022098830 | A2 | 5/2022 |

*Primary Examiner* — Steven A MacDonald

(74) *Attorney, Agent, or Firm* — Mintz Levin Cohn Ferris Glovsky and Popeo, P.C.

(57) ABSTRACT

A system for monitoring and controlling downhole pressure of a well borehole relative to a lithostatic pressure of rock surrounding the borehole is provided. The system can include a millimeter wave drilling apparatus including a gyrotron configured to inject millimeter wave radiation energy into a borehole of a well via a waveguide configured for insertion into the borehole. The borehole can be formed via the millimeter wave drilling apparatus and having a downhole pressure monitored at a bottom of the well. The system can also include a compressor fluidically coupled to the borehole and configured to control the downhole pressure via a gas supplied into and/or received from the borehole. The compressor can be configured to control the downhole pressure relative to a lithostatic pressure determined for rock surrounding the well at the bottom of the well.

10 Claims, 14 Drawing Sheets

(56) References Cited

U.S. PATENT DOCUMENTS 8,627,901 B1 1/2014 Underwood et al.
9,027,668 B2 * 5/2015 Zediker ..... E21B 44/00 175/16
9,416,594 B2 8/2016 Jeffryes et al.
9,562,395 B2 2/2017 Grubb et al.
9,890,594 B2 2/2018 Hanback
10,443,328 B2 * 10/2019 Culen ..... E21B 21/106
10,480,249 B2 11/2019 Samuel et al.
10,533,386 B2 * 1/2020 Oddie ..... E21B 21/08
11,028,648 B1 6/2021 Araque et al.
2002/0010548 A1 * 1/2002 Tare ..... E21B 44/00 702/9
2003/0079912 A1 5/2003 Leuchtenberg
2003/0168257 A1 * 9/2003 Aldred ..... E21B 44/00 175/24
2003/0196804 A1 * 10/2003 Riet ..... E21B 21/106 166/267
2004/0188145 A1 * 9/2004 Moyes ..... E21B 21/08 175/65
2005/0269132 A1 12/2005 Batarseh et al.
2007/0151762 A1 * 7/2007 Reitsma ..... E21B 21/08 175/45
2008/0060846 A1 * 3/2008 Belcher ..... E21B 21/16 175/25
2008/0245568 A1 10/2008 Jeffryes
2010/0133007 A1 * 6/2010 Sehsah ..... E21B 49/003 175/48
2010/0252324 A1 * 10/2010 Woskov ..... E21B 43/26 166/308.1
2011/0025525 A1 2/2011 Akimov et al.
2012/0067643 A1 3/2012 Dewitt et al.
2014/0027178 A1 1/2014 Jeffryes et al.
2015/0041213 A1 * 2/2015 Jeffryes ..... E21B 17/18 175/25
2015/0176333 A1 * 6/2015 Hanback ..... E21B 7/15 175/16
2016/0076322 A1 * 3/2016 Oddie ..... E21B 21/10 73/152.51
2016/0138350 A1 5/2016 Havre et al.
2017/0306703 A1 * 10/2017 Samuel ..... E21B 10/08
2018/0172879 A1 6/2018 Huguet
2022/0136332 A1 5/2022 Araque et al.
2022/0136333 A1 5/2022 Araque et al.

* cited by examiner

500

800

900

1000

1100

1200

BASEMENT ROCK HYBRID DRILLING

CROSS-REFERENCE TO RELATED APPLICATION

This application is a divisional of and claims priority under 35 U.S.C. § 120 to U.S. patent application Ser. No. 17/090,410, filed on Nov. 5, 2020 in the U.S. Patent and Trademark Office, the entire contents of which is incorporated herein by reference.

STATEMENT OF FEDERAL FUNDING

This invention was made with government support under DE-AR0001051 awarded by US Department of Energy (DOE). The government has certain rights in the invention.

TECHNICAL FIELD

The subject matter described herein relates to drilling in sub-surface geologic formations including conventional drilling and other techniques such as millimeter wave drilling, thermal drilling, and the like.

BACKGROUND

Conventional drilling, such as rotary drilling, can be used to form well boreholes so that natural resources, such as oil and gas, can be accessed within sub-surface geologic formations. Conventional drilling can be limited to accessing formations at shallow sub-surface depths and can be less effective at penetrating deeper geologic formations, which can include harder, less permeable rock. Formations of dense rock at deeper depths, often under higher temperature and pressure than rock present at shallow depths, can be accessed more efficiently utilizing non-conventional drilling techniques such as thermal drilling and/or millimeter wave drilling.

SUMMARY

In one aspect, a system for monitoring and controlling downhole pressure of a well borehole relative to a lithostatic pressure of rock surrounding the borehole is provided. In one embodiment, the system can include a millimeter wave drilling apparatus including a gyrotron configured to inject millimeter wave radiation energy into a borehole of a well via a waveguide configured for insertion into the borehole. The borehole can be formed via the millimeter wave drilling apparatus and having a downhole pressure monitored at a bottom of the well. The system can also include a compressor fluidically coupled to the borehole and configured to control the downhole pressure via a gas supplied into and/or received from the borehole. The compressor can be configured to control the downhole pressure relative to a lithostatic pressure determined for rock surrounding the well at the bottom of the well.

In another embodiment, the downhole pressure of the well can be controlled based on an inlet mass flow and a back pressure of the compressor. In another embodiment, the downhole pressure can be monitored by at least measuring a pressure of a fluid provided into and/or extracted from the borehole; and determining the downhole pressure of the well can be performed using one or more of the pressure of the fluid provided into the borehole, the pressure of the fluid extracted from the borehole, a downhole pressure determined when forming a portion of the well using a drilling apparatus including a drill bit, a measure of energy input supplied to the millimeter wave drilling apparatus, and/or a depth of the bottom of the well.

In another embodiment, the downhole pressure of the well can be controlled based on determining a Mach number of the fluid provided into and/or a Mach number of the fluid extracted from the borehole. In another embodiment, the downhole pressure of the well can be controlled based on one or more of the pressure of the fluid supplied into the borehole, the pressure of the fluid received from the borehole, a downhole pressure determined when forming a portion of the well using a mechanical drilling apparatus including a drill bit, a measure of energy input supplied to the millimeter wave drilling apparatus, and/or a depth of the bottom of the well.

In another embodiment, the downhole pressure of the well can be further controlled based on a physical model associated with one or more of the downhole pressure determined when forming a portion of the well using a drilling apparatus including a drill bit, a measure of energy input supplied to the millimeter wave drilling apparatus, and a depth of the bottom of the well. In another embodiment, the downhole pressure can be controlled to drive particulate matter generated by the millimeter wave drilling apparatus during formation of the borehole into fractures in the rock surrounding the well at the bottom of the well.

In another aspect, a system for monitoring and controlling downhole pressure of a well borehole relative to a lithostatic pressure of rock surrounding the borehole is provided. In one embodiment, the system can include at least one data processor and a memory storing computer-readable instructions, which when executed by the at least one data processor can cause the at least one data processor to perform operations. The operations can include monitoring a downhole pressure of a well during formation of a borehole of the well via a millimeter wave drilling apparatus including a gyrotron configured to inject millimeter wave radiation energy into the borehole via a waveguide configured for insertion into the borehole. The monitoring can include determining the downhole pressure, wherein the downhole pressure includes an amount of pressure present at a bottom of the well. The operations can also include controlling the downhole pressure relative to a lithostatic pressure of rock surrounding the well at the bottom of the well based on operational data associated with a compressor fluidically coupled to the borehole.

In another embodiment, the downhole pressure of the well can be controlled based on an inlet mass flow and a back pressure of the compressor.

In another embodiment, the downhole pressure can be monitored by at least measuring a pressure of a fluid provided into and/or extracted from the borehole; and determining the downhole pressure of the well can be performed using one or more of the pressure of the fluid provided into the borehole, the pressure of the fluid extracted from the borehole, a downhole pressure determined when forming a portion of the well using a mechanical drilling apparatus including a drill bit, a measure of energy input supplied to the millimeter wave drilling apparatus, and/or a depth of the bottom of the well.

In another embodiment, the downhole pressure of the well can be controlled based on determining a Mach number of the fluid provided into and/or a Mach number of the fluid extracted from the borehole. In another embodiment, the downhole pressure of the well can be controlled based on one or more of the pressure of the fluid supplied into the borehole, the pressure of the fluid received from the borehole, a downhole pressure determined when forming a portion of the well using a drilling apparatus including a drill bit, a measure of energy input supplied to the millimeter wave drilling apparatus, and/or a depth of the bottom of the well.

In another embodiment, the downhole pressure of the well can be further controlled based on a physical model associated with one or more of the downhole pressure determined when forming a portion of the well using a drilling apparatus including a drill bit, a measure of energy input supplied to the millimeter wave drilling apparatus, and a depth of the bottom of the well. In another embodiment, the downhole pressure is controlled to drive particulate matter generated by the millimeter wave drilling apparatus during formation of the borehole into fractures in the rock surrounding the well at the bottom of the well.

In another aspect, a system for monitoring and controlling downhole pressure of a well borehole relative to a lithostatic pressure of rock surrounding the borehole is provided. In one embodiment, the system can include a means for monitoring a downhole pressure of a well during formation of a borehole of the well, the monitoring including determining the downhole pressure. The downhole pressure can include an amount of pressure present at a bottom of the well. The system can also include a means for controlling the downhole pressure relative to the lithostatic pressure of rock surrounding the well at the bottom of the well.

In another embodiment, the downhole pressure of the well can be controlled based on a mass flow and a back pressure of the means for controlling the downhole pressure.

In another embodiment, the downhole pressure of the well can be monitored by at least measuring a pressure of a fluid provided into and/or extracted from the borehole; and determining the downhole pressure of the well can be performed using one or more of the pressure of the fluid provided into the borehole, the pressure of the fluid extracted from the borehole, a downhole pressure determined when forming a portion of the well, a measure of energy input supplied into the borehole during formation of the borehole, and/or a depth of the bottom of the well.

In another embodiment, the downhole pressure of the well can be controlled based on determining a Mach number of the fluid provided into and/or a Mach number of the fluid extracted from the borehole. In another embodiment, the downhole pressure of the well can be controlled based on one or more of the pressure of the fluid supplied into the borehole, the pressure of the fluid received from the borehole, the downhole pressure determined when forming the portion of the well, the measure of energy input supplied into the borehole during formation of the borehole, and/or the depth of the bottom of the well.

In another embodiment, the downhole pressure of the well can be further controlled based on data associated with one or more of the downhole pressure determined when forming a portion of the well, a measure of energy input supplied into the borehole during formation of the borehole, and a depth of the bottom of the well.

DESCRIPTION OF DRAWINGS

These and other features will be more readily understood from the following detailed description taken in conjunction with the accompanying drawings, in which.

Figure 1:
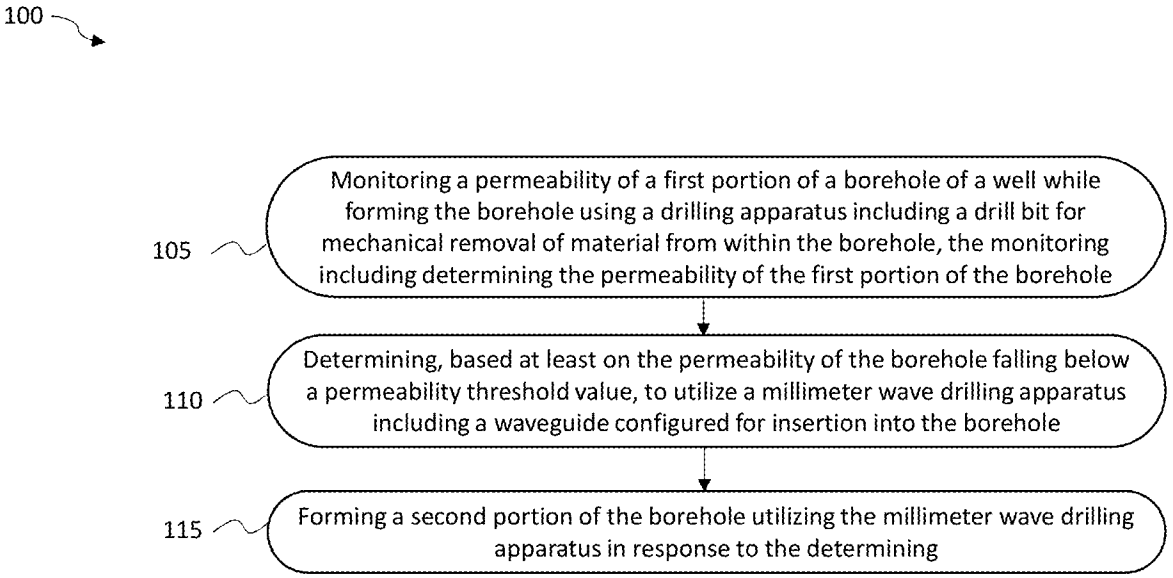
FIG. 1 is a flowchart illustrating one exemplary embodiment of a method for forming a portion of a borehole using a millimeter wave drilling apparatus and system as described herein.

It is noted that the drawings are not necessarily to scale. The drawings are intended to depict only typical aspects of the subject matter disclosed herein, and therefore should not be considered as limiting the scope of the disclosure.

DETAILED DESCRIPTION

Conventional drilling can be used to form boreholes of wells in order to access natural resources, which may be present within sub-surface geologic formations surrounding or close to the borehole. Conventional drilling can include rotary drilling, hammer drilling, and/or a combination of rotary drilling and hammer drilling. Conventional drilling can employ liquids, such as mud or water, and/or gases, such as air or foam, for cleaning and cooling during drilling. Conventional drilling can be employed to form boreholes within soft, porous rock and can include the use of rotating drill bits, such as polycrystalline diamond bits, roller cones, and high-pressure liquid jets. Conventional drilling can utilize rotating drilling apparatuses to cut or grind rock during the formation of the borehole. The cut or ground rock can be removed via a fluid provided into the borehole to lift the cut or ground material from the borehole. Conventional drilling can achieve limited and lower rates of penetration at deeper borehole depths due to increasing temperatures and increasing hardness of the rock present at deeper borehole depths. The ability to transmit power from the surface to the bottom of the borehole can also limit the rate of penetration achieved using conventional drilling in deep boreholes.

Thermal drilling, such as Millimeter Wave Drilling (MMWD) can achieve greater rates of penetration by providing large amounts of radiative energy into the borehole in combination with pressure to melt or vaporize rock. MMWD can be advantageous compared to conventional drilling because the need to physically remove cut, crushed, or ground rock is reduced or eliminated. Instead, rock is vaporized into very small particles or is melted. Higher rates of penetration can be achieved using MMWD compared to conventional drilling because the abundance of applied thermal energy is more effective at penetrating rock compared to rotating mechanical action of conventional drilling. Thus, MMWD can be beneficial forming deeper wells in order to access natural resources or hot dry rock, which can be present at greater depths below the surface.

Deciding when to switch from conventional drilling to thermal drilling, such as millimeter wave drilling, can be difficult to determine and errors in this determination can be costly and hazardous. Accurately identifying when to transition from conventional drilling to millimeter wave drilling can be important for maintaining cost effective rates of penetration during borehole formation. For example, conventional drilling can be used to form a first portion of a borehole down to a depth at which a rate of penetration of a conventional drilling apparatus slows due to the hardness of the rock and/or the presence of high temperatures. Performing conventional drilling at deeper depths can require additional time, personnel, and equipment to monitor and conduct the conventional drilling and can increase the costs and risks associated with forming the borehole at deeper depths compared to non-conventional drilling, such as MMWD.

Accordingly, some implementations of the current subject matter can provide for an approach to determining when to switch from conventional drilling to utilize a millimeter wave drilling apparatus. Because millimeter wave drilling extends the borehole by using thermal heating (e.g., the millimeter waves heat the rock), if the material is permeable, it may allow for liquid (e.g., water) to penetrate through the porous material into the borehole. Additional liquid within the borehole can interfere with the millimeter wave drilling system by cooling down the borehole. In other words, the millimeter waves will vaporize the liquid (e.g., water) rather than borehole rock. This can also increase the risk of a blowout. Accordingly, some implementations of the current subject matter include monitoring or inferring the permeability of the borehole while utilizing the rotational drilling approach and determining to use the millimeter wave apparatus once the permeability of the rock at the bottom of the borehole falls below a permeability threshold value. The monitoring can be direct or indirect, for example, it can be difficult to directly monitor (e.g., measure) permeability in low permeability zones. As a result, in some implementations, permeability can be inferred from other measurements, such as porosity of rock. Porosity can be more readily determined using some existing tools.

In some implementations, temperature and/or hardness of the rock at the bottom of the borehole can be monitored during conventional drilling and the decision to switch to MMWD can be further based on temperature and/or hardness of the rock. By basing the determination to switch to MMWD on permeability, temperature, and/or hardness of rock, rather than the costs associated with the drilling, some implementations of the current subject matter can provide for determining to switch to thermal drilling, such as MMWD, at a point in which the overall operation of the MMWD is improved, and therefore result in an improved approach to drilling.

In some implementations, during millimeter wave drilling, control of the well needs to be maintained to prevent collapse of the well. For example, conventional drilling approaches can use liquids (e.g., mud) to lubricate and to control the downhole pressure, and can utilize metallic casings and cement to support the borehole (e.g., to prevent collapse). The mud weight and filter cake formed around the wellbore walls by the mud can prevent collapse. Metallic casings can be inserted after drilling and can be cemented in place to maintain the stability of the wellbore. But liquids (e.g., mud) may not be transparent to millimeter waves. Installing casings and cementing can be increasingly difficult as the temperature within the borehole increases. Millimeter wave drilling can utilize gases but low pressures can cause the well to collapse. Accordingly, some implementations of the current subject matter include monitoring a downhole pressure of a well during formation of a borehole of the well using a millimeter wave drilling apparatus, determining a lithostatic pressure of rock surrounding the well at the bottom of the well, and controlling the downhole pressure relative to the lithostatic pressure of the rock surrounding the well at the bottom of the well. By controlling the downhole pressure using a managed pressure drilling approach as described herein, the downhole pressure can be controlled relative to the lithostatic pressure of the rock so that well control can be maintained and well collapse can be prevented or inhibited. In addition to controlling pressure to prevent wellbore collapse, pressure can be controlled to reach a lithostatic pressure, or a fracture pressure. Controlling pressure to reach or exceed the lithostatic pressure can enable a balanced or overbalanced condition. And controlling pressure to reach a fracture pressure can allow for pushing melt created by the MMWD process into the formation, instead of flowing the condensed rock particles back to surface.

The managed pressure drilling approach described herein can be advantageous compared to other pressure drilling approaches, which can create an overbalanced pressure condition within a closed volume of the wellbore. The managed pressure drilling approach described herein can be used in an open volume system. An open volume system can be configured to actively circulate fluids and/or gases from the surface, down the wellbore to the cutting front, and back to the surface. Actively circulating the fluids and/or gases can help cool and lubricate drilling components and can transport cuttings to the surface. The direction of the active circulation can be normal or reversed. In normal circulation, the fluid and/or gas is provided into the wellbore through the waveguide and returns through the wellbore annulus. In reverse circulation, the fluid and/or gas is provided into the wellbore via the wellbore annulus and returns from the wellbore through the waveguide. In contrast, a closed volume system forms a flow restriction along the circulation path. For example, a full blockage or partial blockage of the flow can be used to manage the downhole pressure. A closed volume system can be used to perform the managed pressure drilling approach described herein. In a closed volume system, the pressures within a closed loop of the closed volume system can be higher at each point of the circulation path as compared to the open volume system.

An improved system and method for performing hybrid MMWD to form well boreholes is described herein. The hybrid MMWD systems and methods can provide advantages that can be difficult to achieve using conventional drilling or MMWD alone to form an entire borehole. For example, conventional drilling can be performed efficiently in shallow subsurface rock formations between 0 km and 3 km deep where the rock is softer, shallower, and/or has a lower mechanical specific energy. For example, the mechanical specific energy for conventional drilling rock can be about 100 Joules/$cm^3$ of rock, whereas the mechanical specific energy for melting rock can be about 5000 Joules/$cm^3$ of rock. The mechanical specific energy for vaporizing rock can be about or greater than 12,000 Joules/$cm^3$ of rock. At depths greater than 5 km, conditions can favor use of MMWD. Drilling wells deeper than 5 km using conventional drilling approaches can take a longer amount of time than if the wells were drilled using the hybrid MMWD systems and methods described herein.

As rock hardness, permeability, and borehole temperature increase at greater depths, the rate of penetration can slow and the cost of continuing the conventional drilling operation can increase. The mechanical efficiency of conventional drilling at greater depths and in less permeable rock can diminish due to the increased wear on the drill bit, and the increased friction and torque transmission required to penetrate the rock. Rotary drill bits can wear out more quickly in these conditions. The cost and workflow associated with maintaining the borehole can also be increased at depths using conventional drilling. For example, larger, more expensive, shallower borehole casings can be required to accommodate larger sized drill bits necessary to make boreholes at greater depths.

Borehole temperatures can also affect when to switch from conventional drilling to MMWD. For example, depths at which borehole temperatures can exceed 260 degrees C. can be problematic for the electronic components used in conventional drilling. In addition, at depths where these temperature conditions can be present, the lifting and cooling properties of the mud can diminish due to breakdown of the fluid by the high temperatures. Conventional drilling at these depths and temperatures can utilize drill bits rated to 300 degrees C., however this can require operators to circulate mud at high rates in a constant manner.

MMWD, while more efficient at forming boreholes in less permeable and/or hard rock at higher temperatures and greater depth, can be less advantageous when forming an initial portion of a borehole near the surface at least due to the lower mechanical specific energy required for shallower rock formations. For example, MMWD provides large amounts of radiative energy into the borehole to melt or vaporize rock. MMWD systems include millimeter wave producing apparatuses called gyrotrons and utilize waveguides to form and direct the energy into the borehole. Deploying such systems to form an entire borehole to significant depths is not always cost efficient or mechanically efficient to adequately remove certain types of rock present in initial portions of a borehole. For example, in shallow sub-surface formations where an initial portion of a borehole can be formed, the rock can include limestone which is not effectively vaporized or melted using MMWD. The hybrid MMWD system and methods described herein can utilize conventional drilling and subsequently MMWD to form boreholes to greater depths than conventional drilling alone and can provide greater rates of penetration when rock permeability and/or rock hardness decreases, and/or when borehole temperature or pressure increases, as exist in deeper sub-surface formations of rock.

FIG. 1 is a flowchart illustrating one exemplary embodiment of a method 100 for forming a portion of a borehole using a millimeter wave drilling apparatus and system as described herein. In operation 105, a permeability of a first portion of a borehole is monitored while forming the borehole using a drilling apparatus including a drill bit for mechanical removal of material from within the borehole. In some embodiments, monitoring the permeability of the first portion of the borehole can include inferring (e.g., determining) the permeability based on rock porosity and fluid saturation measured within the borehole. A model, determined based on core measurements (e.g., the measurements of the rock porosity and fluid saturation measured within the borehole), can be used to determine the permeability of the first portion of the borehole. In some embodiments, the porosity and saturation of the borehole can be monitored in place of the permeability of the borehole. The drilling apparatus can be configured to perform conventional drilling, percussion drilling, churn drilling, diamond drilling, or the like. In some embodiments, the monitoring can include monitoring a temperature of the borehole, a rate of penetration of the drill bit of the drilling apparatus, and/or a hardness of a material present within the first portion of the borehole. In some embodiments, the monitoring can be performed using a data processor, such as using a computing device configured to receive data corresponding to the permeability. In some embodiments, the data processor can also be configured to monitor the temperature of the borehole, the rate of penetration of the drill bit, the hardness of the material, and any combination thereof.

Permeability of the first portion of the borehole can be monitored based on data associated with a fluid applied into and received from the borehole. For example, the fluid can be supplied into and received from the borehole to remove the cut or ground material. The rate of fluid or the pressure of the fluid can be used to infer a permeability of the rock surrounding the first portion of the borehole. In some embodiments, the permeability can be inferred from logging data collected while forming the first portion of the borehole or a borehole at a different location. Logging data can include, for example, logs from logging while drilling (LWD) records, which can be created by conventional drilling approaches. In some embodiments, permeability can be monitored based on core samples sent to a lab for direct measurement. For example, by flowing a single phase fluid thru a core of a known diameter and length, the pressure drop across the rock sample can be measured. The permeability of the core samples can be calculated using Darcy's law. In some embodiments, the permeability can be monitored via measurement with wireline logging tools. In some embodiments, the permeability can be monitored via measurement with downhole pressure and sampling tools. In some embodiments, the permeability can be monitored using drill stem testing (DST). DST can be used to determine the average in situ permeability based on transient analysis of downhole pressures. In some embodiments, the permeability can be determined based on historical data derived from offset wells that are drilled nearby a well being monitored. In some embodiments, the permeability can be inferred based on monitoring porosity and fluid saturation to infer an acceptable amount of ingress fluid within the borehole. In some embodiments, the permeability can be monitored or determined using measurement while drilling (MWD), which can include use of formation evaluation tools to provide reservoir information in real time or near real time.

Temperature of the borehole can be monitored using one or more downhole sensors. Downhole sensors can be utilized to approximately 300 degrees C. Currently "ultra-high" temperature drilling fluids are rated to 260 degrees C. or about 500 degrees F. and "ultra-high" temperature motors are similarly rated for 260 degrees C. or about 500 degrees F. The ultra-high temperature motors can operate in higher temperature zones than rotary steerable motors because they do not include downhole electrical components. Rotary steerable systems (RSS) and motors are typically limited to maximum downhole temperatures of 200 degrees due to the temperature limits associated with the downhole electrical components. "High"-temperature drilling fluids and motors can be rated to about 200 degrees C. or about 400 degrees F. "Normal" temperature drilling fluids and motors can be rated to about 150 degrees C. or about 300 degrees F. Conventional drilling can drill into high reservoir temperature zones, but can require circulating large volumes of drilling fluid to cool the borehole in order to keep within any temperature limits of the drilling equipment.

In some embodiments, the temperature of the borehole can be inferred from the fluid received from the borehole. In some embodiments, such as when performing MMWD, the temperature of the borehole can be determined using pyrometry and/or radiometry. In some embodiments, the temperature of the borehole can be measured while drilling, for example using a resistance temperature detector (RTD) or a fiber optic sensor. In some embodiments, the temperature of the borehole can be measured using wireline logging tools. In some embodiments, the temperature of the borehole can be determined based on historical data. In some implementations, temperature can be determined by analyzing LWD records. In some embodiments, RSS tools can monitor the control unit temperature. In some embodiments, the temperature can be monitored at the drill bit using a memory gauge. In some embodiments, the borehole temperature can be monitored using a RTD whilst logging while drilling. Other approaches are possible.

A rate of penetration (ROP) of the drill bit of the drilling apparatus can be monitored using one or more sensors configured on or associated with the drilling apparatus including the drill bit. In some implementations, ROP can be determined by analyzing LWD records. In some implementations, ROP may not be the only indicator for use in determining when to switch to use of the hybrid MMWD system and methods described herein. For example, ROP can be reduced for a variety of issues, all of which can be related to the RSS, motor, and drill bit, as well as how these components behave dynamically. ROP can also be reduced due to the presence of a hard rock layer in one location followed by a next rock layer that is more permeable and soft. Primary factors affecting ROP include rock depth, rock porosity, rock permeability, downhole temperature, and mechanical specific energy. Monitoring ROP from the surface, such as from a block position, is typically required as integrating accelerometers into the downhole environment can produce poor results. Measurements while drilling (MWD) can utilize accelerometers and magnetometers to provide spatial orientation of the bottom hole assembly (BHA) from which ROP can be determined.

An effective ROP (EROP) can be a ROP that accounts for the amount of time that is not spent on making the borehole deeper. For example, an EROP can include the amount of time needed to remove and replace a worn drill bit. MMWD does not require such extraneous time since MMWD does not require replacing worn drill bits or BHA components. As a result, the amount of non-productive time (NPT) spent forming the borehole can be reduced and the EROP, or a time to a target depth, can be significantly less than conventional drilling. In addition, the borehole formed via MMWD is vitrified and may not require the application of casings or cement therein. This can further reduce the amount of NPT and increase the EROP. In some embodiments, the hybrid MMWD system and methods described herein can achieve about 1 mm/second EROP. Thus, some example implementations of the hybrid MMWD system and methods described herein can achieve about 10 km of depth in 100 days of drilling.

A hardness of the material present within the first portion of the borehole can be monitored based on the rate of fluid exiting the borehole. In some embodiments, the hardness of the material can be inferred or measured from data associated with the permeability of the first portion of the borehole. In some embodiments, the hardness of the material can be inferred or measured from analyzing rock cuttings. For example, the type of rock can indicate a hardness of the rock. In some embodiments, the hardness of the material can be inferred or measured using a logging tool. The logging tool measurements can be acquired while drilling or using a wireline tool, such as a thru-bit logging configuration. In some embodiments, the hardness of the material can be inferred or measured from the frequency at which worn drill bits are changed. In some embodiments, the hardness of the material can be inferred or measured from direct measurement of core samples. In some embodiments, the hardness of the material can be inferred or measured from historical data. In some embodiments, the hardness of the material can be inferred or measured from an amount of surface torque or downhole torque, an amount of weight on a drill bit, the ROP, and/or revolutions per minute (RPM) of the drill bit. Excessive vibration and low ROP can be indicative of harder material. In some embodiments, at-bit or in-bit logging tools can provide weight-on-bit (WOB), down-hole WOB (DWOB), torque-on-bit (TOB), and/or down-hole TOB (DTOB) data from which hardness can be inferred. In addition, MWD tools can provide formation evaluation data from which a type of rock formation and corresponding rock hardness can be inferred.

Based on the aforementioned measurements, and/or data, proxy measurements corresponding to the hardness of the material can be calculated. In some embodiments, the proxy measurements can include an apparent formation strength. For example, the apparent formation strength can be calculated as (DWOB*RPM)/(ROP*depth). In some embodiments, the proxy measurements can include a measure of the drilling specific energy. For example, the drilling specific energy can be calculated as ((8 DTOB*RPM)/(depth$^2$*ROP)). In some embodiments, the proxy measurements can include a measure of the mechanical work required to destroy a unit volume of rock.

In operation 110, a determination to utilize a MMWD apparatus including a waveguide configured for insertion into the borehole can be made. The determination can be made based at least on the permeability of the borehole falling below a permeability threshold value. For example, based on determining the permeability of the borehole and determining a decrease in permeability of the rock surrounding the borehole as the drilling apparatus drills deeper, the determination to switch to a MMWD apparatus can be made. In some implementations, the determination can be made by a first data processor of a first computing device associated with the monitoring performed in operation 105, by a second data processor associated with a second computing device located remotely from the data processor and computing device where the monitoring data is received, or by a combination of the first and second data processors. In some embodiments, the determination can be made based on inferred borehole permeability rather than a borehole permeability that is directly measured within the borehole.

The permeability threshold value can be a value determined from previous borehole formations. In some embodiments, the permeability threshold value can be determined based on geologic surveys identifying the composition of the sub-surface formations and rock present in the area of the well borehole. The threshold permeability value can be a value that would result in a fluid inflow, in m$^3$/s or equivalent units, that would be too high for the amount of energy available to drill. For example, since MMWD can heat all materials within the downhole, a 1 mm/s ROP on an 8" diameter borehole implies that material can be removed at a rate of 0.0000324 m$^3$/s (3.24 E-5 m$^3$/s) assuming a total energy to vaporize rock of 25000 Joules/cm$^3$. If fluid was flowing into the borehole at the same rate, the ROP would become zero. In this example, ROP would be canceled because the energy generated via MMWD would be transmitted into the incoming fluid rather than the rock formations. Thus, a threshold permeability value can be a function of permeability, a difference in lithostatic pressure and wellbore pressure, and a desired ROP. In some embodiments, the permeability threshold value can be between 1.0 microdarcy (uD) and 10.0 milidarcy (mD) values.

In some embodiments, operation 110 can also include determining to utilize a MMWD apparatus based on a monitored temperature of the borehole exceeding a temperature threshold value. In some embodiments, the temperature threshold value can be determined as a function of the type of conventional drilling equipment used. For example, the maximum temperatures can be associated with a temperature rating of the equipment. The temperature rating for equipment that includes electronics within the drilling equipment can be limited to 260 degrees C., while the temperature rating for a motor lining of the drilling equipment can be limited to 150 degrees C. As a result, the maximum temperature can be determined by the lowest temperature of these two.

For non-geothermal wells, the well is formed without a RSS using geosteering. In this way, the well can be drilled deeper, but may not be truly vertical. As a result, a transition to MMWD may not be optimal. When RSS is used to form an initial portion of the borehole, the RSS should be operated in inclination hold mode so that any vertical deviation of the borehole formation is minimized. In some implementations, the borehole formed by the rotary drill is near-vertical to improve the performance of MMWD, and use of a RSS or similar technique can enable a more vertical borehole, as compared to some boreholes formed by rotary drills, which can appear helical.

In some embodiments, operation 110 can also include determining to utilize a MMWD apparatus based on an effective rate of penetration of the drill bit of the drilling apparatus falling below a rate of penetration threshold value. In some embodiments, the rate of penetration threshold value can be determined based on geologic surveys identifying the composition of the subsurface formations and rock present in the area of the well borehole. In some embodiments, the rate of penetration threshold value can be determined based on historical data. In some embodiments, the rate of penetration threshold value can be determined based on modeling and simulation data of expected EROP through known formation types for both rotary and MMWD systems and/or methods. In some embodiments, the effective rate of penetration threshold value can be between 0.5 and 2.0 mm/s.

In some embodiments, operation 110 can also include determining to utilize a MMWD apparatus based on a monitored hardness of a material present in the first portion of the borehole exceeding a hardness threshold value. In some embodiments, the hardness threshold value can be determined based on geologic surveys identifying the composition of the sub-surface formations and rock present in the area of the well borehole. In some embodiments, the hardness threshold can be determined based on analysis of cuttings removed from the borehole and based on analysis of a drill bit when the drill bit is replaced. In some embodiments, the hardness threshold can be determined based on a correlation between the ROP, weight on the drill bit, and torque applied to the drill bit. In some embodiments, the hardness threshold value can be between 4 and 6 as measured on the Mohs hardness scale. In some embodiments, the hardness threshold value can be a value above 100 MPa compressive strength of the rock. In some embodiments, the hardness threshold value can correspond to an amount of downhole torque or a mechanical specific energy.

In operation 115, a second portion of the borehole can be formed utilizing the MMWD apparatus in response to the determining. The MMWD apparatus can be configured to form a second portion of the borehole at the point it is determined that the conventional drilling apparatus is no longer achieving adequate progress to form the borehole with respect to the various threshold values used in operation 110. It can be advantageous to form the second portion of the borehole using a MMWD apparatus not based just on the financial cost of operating the conventional drilling apparatus, but instead, based on more robust analysis of geophysical variables associated with the conventional drilling operations, such as the permeability, temperature, hardness of the borehole, and the rate of penetration of the conventional drilling apparatus. In this way, the decision to change from a conventional drilling apparatus to a MMWD apparatus can be made in a more precise manner which can yield cost savings, greater penetration rates, and safer drilling operations than determining to change from conventional drilling to MMWD based on costs alone. The decision to change from the conventional drilling apparatus to the MMWD apparatus can also reduce or eliminate well completion steps requiring the need to install casings and cement. Prior to switching to the MMWD apparatus, the well can be cased and cemented, and the mud can be replaced by a gas configured for use in MMWD.

Figure 2:
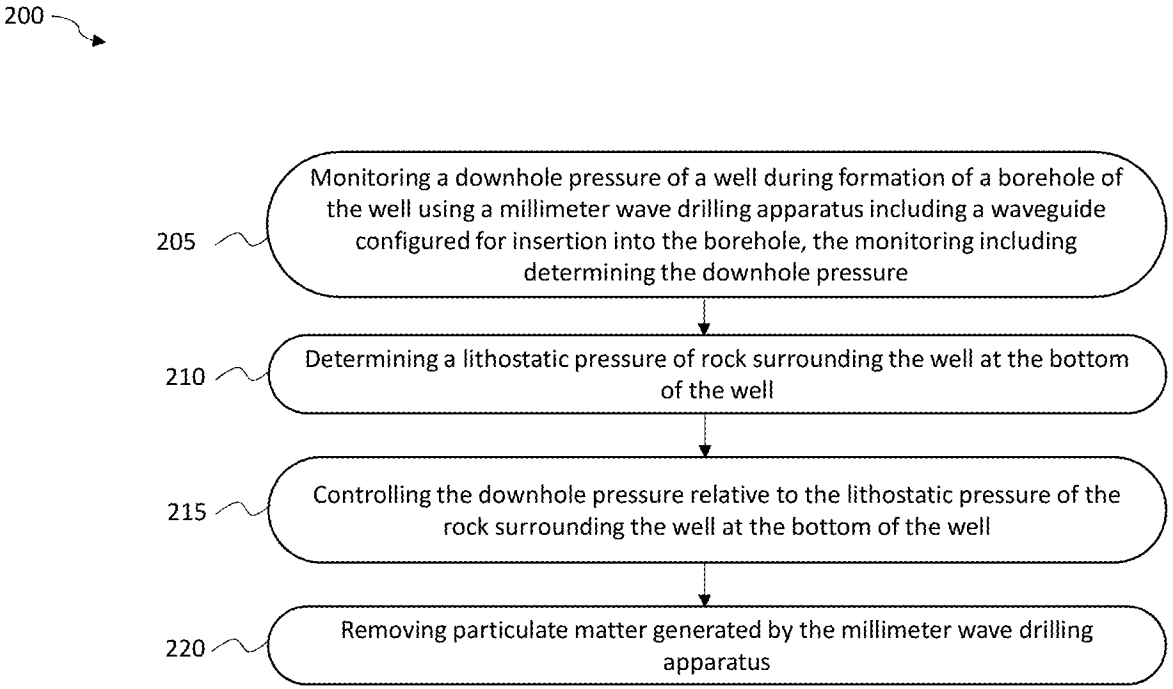
FIG. 2 is a flowchart illustrating one exemplary embodiment of a method for controlling a downhole pressure of a well formed using a millimeter wave drilling apparatus and system as described herein.

FIG. 2 is a flowchart illustrating one exemplary embodiment of a method 200 for controlling a downhole pressure of a well formed using a millimeter wave drilling apparatus and system as described herein. Controlling the downhole pressure during formation of the borehole can be important to ensure structural stability of the borehole and to manage inflow of any fluid into the borehole. It can be desirable to maintain the bottom of the borehole at a pressure sufficient to prevent hole collapse. In some cases, an amount of sufficient pressure can be less than a lithostatic pressure of the surrounding rock. In some cases, the amount of sufficient pressure can be greater than a lithostatic pressure of the rock surrounding the borehole. For example, the downhole pressure would be controlled to be higher than the lithostatic pressure so that fracturing of the rock can be enhanced and particulate matter from the melted or evaporated rock can be driven into fissures of the surrounding rock. In some embodiments, a pressure in the wellbore can be at least 2*density of the rock*gravity*depth−compressive strength of the rock. In some embodiments, no pressure in the wellbore is needed. For example, at lesser depths the rock is competent enough to support itself.

In operation 205, a downhole pressure of a well is monitored during formation of a borehole of a well using a MMWD apparatus including a waveguide configured for insertion into the borehole. The monitoring can include determining the downhole pressure of the borehole. The downhole pressure of the borehole can include an amount of pressure present at the bottom of the well or borehole. The downhole pressure of the well or borehole can be determined based on a surface pressure and a pressure of a gas supplied into the borehole during the MMWD. For example, one or more of a surface injection pressure, a flow rate, one or more fluid property, a flow area dimension, a depth, a bottom hole temperature, and/or a last physical bottom hole pressure measurement from conventional drilling methods may be known. An injection rate, the fluid properties, the flow area, and the depth can be used to calculate a pressure drop. The depth and the fluid properties can be used to calculate a hydrostatic pressure. The Ideal Gas Law, or another empirical equation, can be used to determine a pressure increase to due temperature increase, e.g., (PV=NRT). These calculated values can be used to determine the bottom hole pressure.

In some embodiments, a modified Bernoulli equation, a Darcy-Weisbach Equation, a Fanning equation, and/or a Hazen-Williams equation can be used to solve for the pressure at a 2nd point. By comparing the calculated bottom hole pressure to the last measurement bottom hole pressure measurement, a determination of the downhole pressure can be made in relation to the reference value. The last bottom hole pressure measurement can be linearly extrapolated to deeper bottom hole pressure values in a continuous manner to determine if the bottom hole pressure is sufficient or needs to be increased to maintain the integrity of the borehole.

In some embodiments, the model can further correlate an amount of input energy supplied to the gyrotron of the MMWD apparatus to downhole pressure. In some embodiments, the model can include downhole pressure data associated with conventional drilling, such as rotary drilling. In some embodiments, the downhole pressure can be determined via modeling the wellbore flow, based on the downhole temperature, the depth (e.g., the wellbore volume), the inflow, and the inlet/outlet pressure. In operation 210, a lithostatic pressure of rock surrounding the well at the bottom of the well can be determined. In some embodiments, the lithostatic pressure can be determined based on past geologic survey data and/or a model of geophysical data associated with the well site.

In operation 215, the downhole pressure can be controlled relative to the lithostatic pressure of the rock surrounding the well at the bottom of the well. Controlling the downhole pressure can be important to overbalance, underbalance, or balance the downhole pressure with respect to the lithostatic pressure to maintain the structural stability of the borehole and the well. A highly underbalanced condition of the downhole pressure relative to the lithostatic pressure of the surrounding rock could cause instability and collapse of the borehole. In some embodiments, a Rotating Pressure Control Head (RCPH) can be used.

In some embodiments, the downhole pressure can be controlled via controlling operation of a gas compressor positioned at the surface where the entrance to the borehole is located. The gas compressor can be configured to supply a gas into the borehole via one or more valves, such as input and output valves. The downhole pressure can be controlled by controlling an input valve position of the gas compressor, an output valve position of the gas compressor, and/or a flow rate of the gas supplied by the gas compressor. In some embodiments, the flow rate of the gas can be between 0.5 m/s and 50 m/s. In some embodiments, the downhole pressure can be controlled via the inlet mass flow and the back pressure of the compressor. In some embodiments, the downhole pressure can be controlled based on calculating a Mach number of the flow at different places (e.g., at orifice plates).

In operation 220, particulate matter generated by the MMWD apparatus can be removed. MMWD can produce small particulate matter formed as a result of vaporizing rock. For example, the particulate matter can be less than one micron in size. The particles can be removed by applying a gas flow to remove the particles. In some embodiments, the downhole pressure can be controlled to remove particles by driving them into fractures within the surrounding rock, thus reducing the need to lift the particles out from the borehole.

Figure 3:
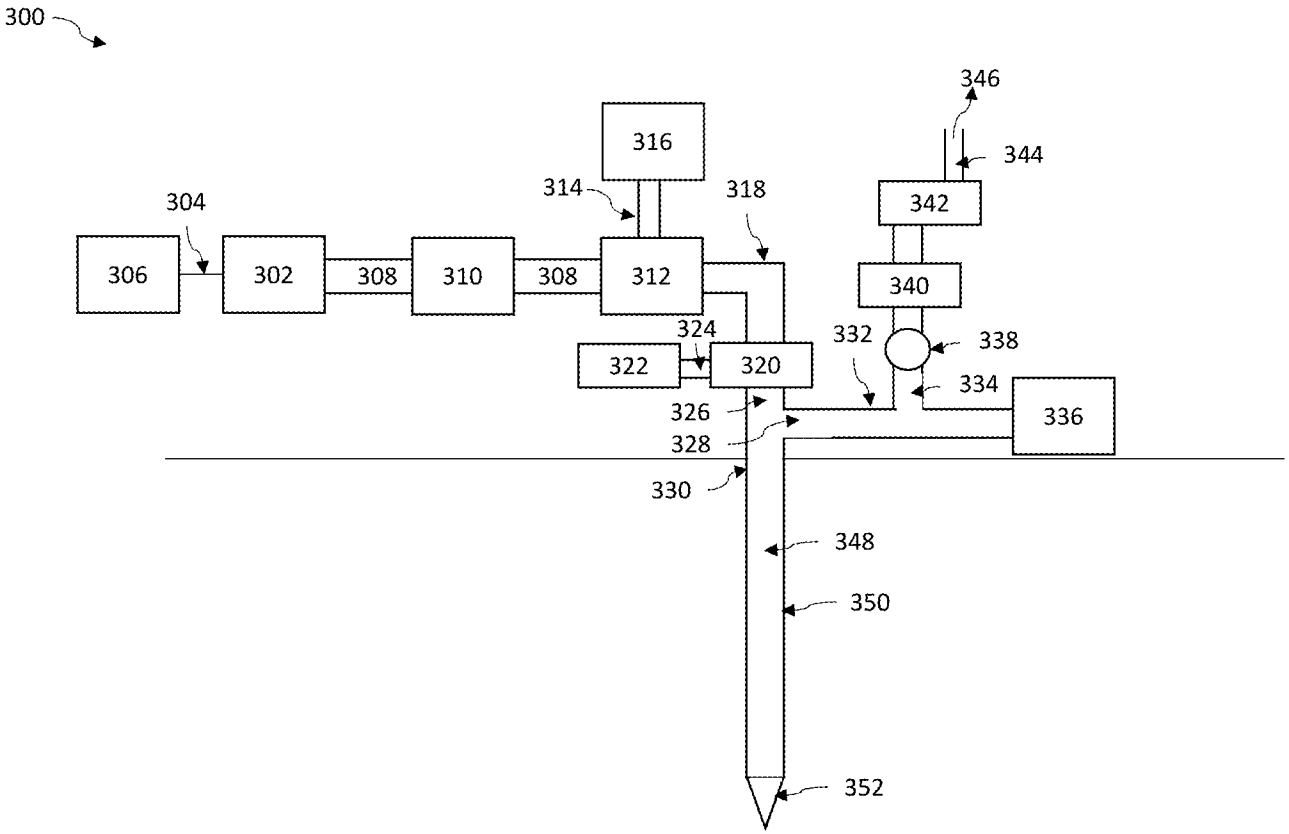
FIG. 3 is a diagram illustrating an exemplary embodiment of a millimeter wave drilling system configured to perform the methods of FIGS. 1 and 2 as described herein.

FIG. 3 is a diagram illustrating an exemplary embodiment of a millimeter wave drilling apparatus 300 configured to perform the methods of FIGS. 1 and 2 as described herein. The millimeter wave drilling apparatus 300 shown in FIG. 3 can be configured as described in U.S. Pat. No. 8,393,410 to Woskov et. al, entitled "Millimeter-wave Drilling System," the entirety of which is incorporated by reference herein. The MMWD apparatus 300 shown in FIG. 3 includes a gyrotron 302 connected via power cable 304 to a power supply 306 supplying power to the gyrotron 302. The high power millimeter wave beam output by the gyrotron 302 is guided by a waveguide 308 which has a waveguide bend 318, a window 320, a waveguide section 326 with opening 328 for off gas emission and pressure control. A section of the waveguide is below ground 330 to help seal the borehole.

As part of the waveguide transmission line 308 there is an isolator 310 to prevent reflected power from returning to the gyrotron 302 and an interface for diagnostic access 312. The diagnostic access is connected to diagnostics electronics and data acquisition 316 by low power waveguide 314. At the window 320 there is a pressurized gas supply unit 322 connected by plumbing 324 to the window to inject a clean gas flow across the inside window surface to prevent window deposits. A second, pressurization unit 336 is connected by plumbing 332 to the waveguide opening 328 to help control the pressure in the borehole 348 and to introduce and remove borehole gases as needed. The window gas injection unit 322 is operated at slightly higher pressure relative to the borehole pressure unit 336 to maintain a gas flow across the window surface. A branch line 334 in the borehole pressurization plumbing 332 is connected to a pressure relief valve 338 to allow exhaust of volatized borehole material and window gas through a gas analysis monitoring unit 340 followed by a gas filter 342 and exhaust duct 344 into the atmosphere 346. In an alternative embodiment, the exhaust duct 344 returns the gas to the pressurization unit 336 for reuse.

Pressure in the borehole is increased in part or in whole by the partial volatilization of the subsurface material being melted. A thermal melt front 352 at the end of the borehole 348 is propagated into the subsurface strata under the combined action of the millimeter wave power and gas pressure leaving behind a glassy/ceramic borehole wall 350. This wall acts as a dielectric waveguide to transmit the millimeter wave beam to the thermal front 352.

Figure 4:
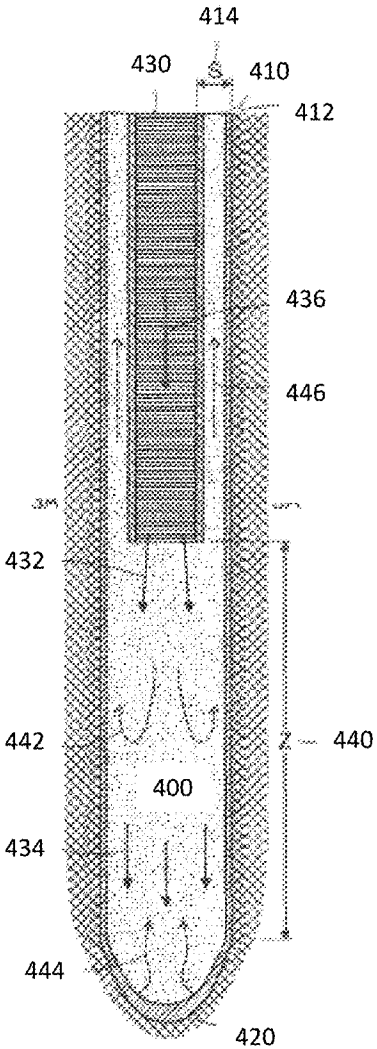
FIG. 4 is a diagram illustrating a cross sectional view of a borehole including a metallic waveguide for low loss transmission of millimeter wave radiation.

FIG. 4 is a diagram illustrating a more detailed view of MMWD and corresponding to the MMWD system described in U.S. Pat. No. 8,393,410 to Woskov et. al, entitled "Millimeter-wave Drilling System." The borehole 400 with glassy/ceramic wall 410 and permeated glass 412 has a metallic waveguide section 430 inserted to improve the efficiency of gyrotron beam propagation. The inserted waveguide diameter is smaller than the borehole diameter to create an annular gap 414 for exhaust/extraction. The standoff distance 440 of the leading edge of metallic insert waveguide from the thermal melt front 420 of the borehole is far enough to allow the launched millimeter wave beam divergence 432 to fill 434 the dielectric borehole 400 with the guided millimeter-wave beam. The standoff distance 440 is also far enough to keep the temperature at the metallic insert low enough for survivability. The inserted millimeter-wave waveguide also acts as a conduit for a pressurized gas flow 436 from the surface. This gas flow keeps the waveguide clean and contributes to the extraction/displacement of the rock material from the bore hole. The gas flow from the surface 436 mixes 442 with the volatilized out gassing of the rock material 444 to carry the condensing rock vapor to the surface through annular space 414. The exhaust gas flow 446 is sufficiently large to limit the size of the volatilized rock fine particulates and to carry them all the way to the surface.

Figure 5:
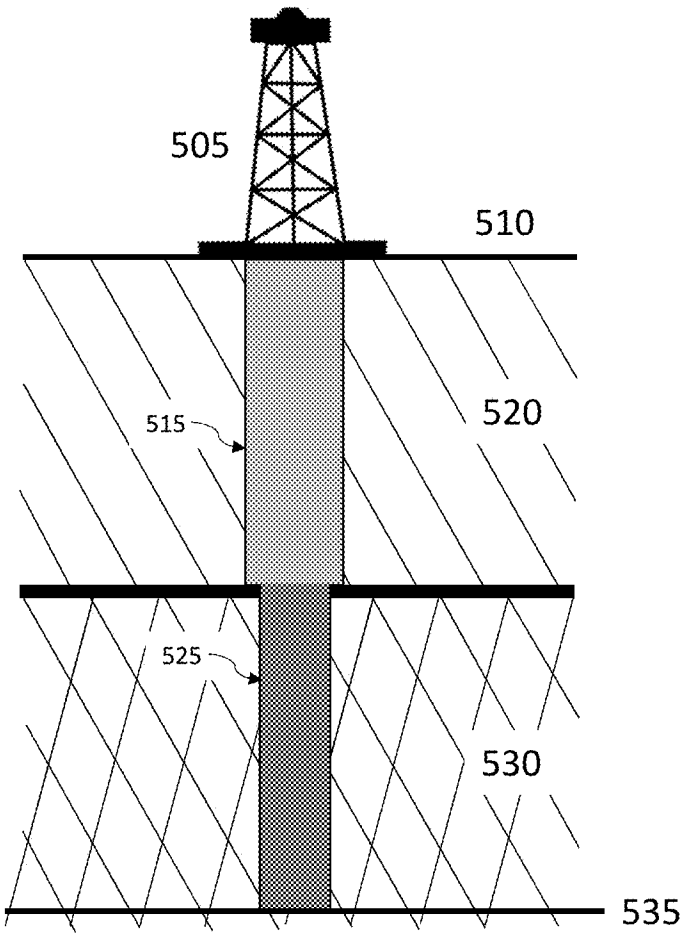
FIG. 5 is a diagram illustrating an exemplary embodiment of a hybrid drilling approach using the millimeter wave drilling system described herein.

FIG. 5 is a diagram illustrating an exemplary embodiment of a hybrid drilling system 500 configured to use the millimeter wave drilling system described herein. The hybrid drilling system and methods described herein use a hybrid drilling method to effectively drill through rock, such as basement rock. The hybrid drilling system and methods are advantageous compared to conventional drilling alone because the benefits of conventional drilling and MMWD can provide an optimized solution for drilling in less permeable or hard rock, such as basement rock. The first step of the hybrid drilling system and methods described herein leverages conventional drilling. The hybrid drilling system and methods can utilize a liquid-based drilling process initially to ensure stability and control of the wellbore during an initial formation. Casing and cement can be installed during the initial formation of the wellbore to seal the wellbore and prevent wellbore collapse. When sealed, the drilling mud can be circulated out of the wellbore and the wellbore can be cleaned before evacuating the wellbore to ensure all remaining fluids have been pushed out. Evacuating can include pushing all liquids out of the hole so that the well is full of a gaseous medium, such as nitrogen, argon, or any gas substantially transparent to millimeter waves. A subsequent step using MMWD can be initiated once basement rock is reached, or the penetration rate has slowed significantly, or high temperatures prevent further progress with the conventional drilling apparatus. With the wellbore prepared for MMWD, the second drilling step utilizing MMWD can begin. Occasionally, it may be necessary to revert to conventional drilling and to then subsequently utilize MMWD again. Such iterative methods can be repeated multiple times depending on the geological conditions. In some cases, conventional drilling can proceed with gases rather than liquids to minimize the fluid changeover operations.

As shown in FIG. 5, the hybrid drilling system includes surface equipment 505, such as a conventional drilling apparatus configured on the surface 510, used to form the first portion of the borehole 515 in non-basement rock 520. A second portion of the borehole 525 can be formed via a MMWD apparatus in basement rock 530 to achieve a desired target depth 535.

Figure 6:
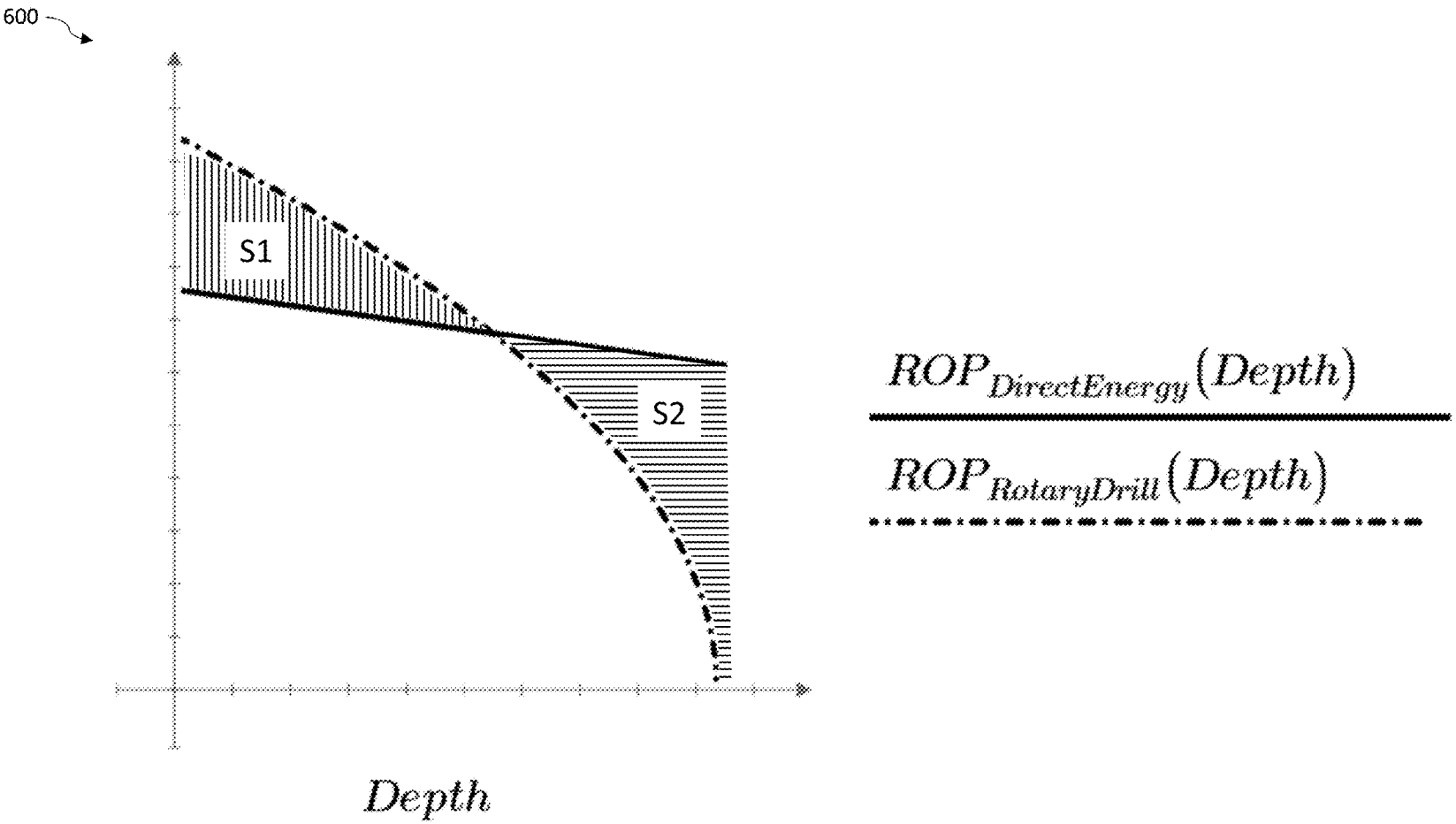
FIG. 6 is a diagram illustrating a plot of a rate of penetration attainable using the millimeter wave drilling system described herein.

FIG. 6 is a diagram illustrating a plot 600 of a rate of penetration attainable using the millimeter wave drilling system described herein. As shown in FIG. 6, the vertical axis is the effective rate of penetration (EROP) and is shown as a function of depth on the horizontal axis. At a given depth at, or near the basement rock, the conventional drilling method effectiveness will severely drop off. The region S1 corresponds to step one where the conventional drilling method can provide a more efficient borehole formation. The region S2 corresponds to step two where the direct energy method, e.g., the use of MMWD, can provide a more efficient borehole formation. The point at which the two curves intersect may be near the basement rock, and this is the point where it may be advantageous to switch from a conventional drilling method to a MMWD method.

Figure 7:
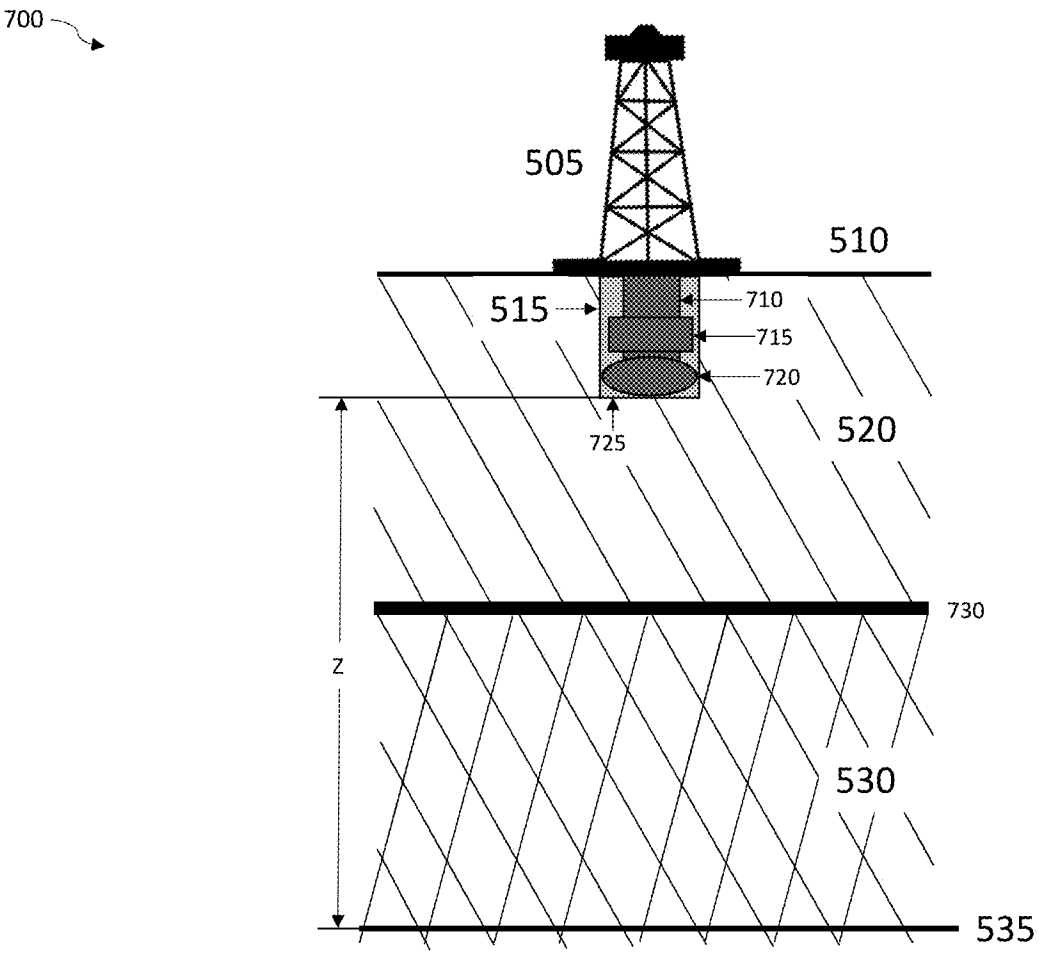
FIGS. 7-12 and 14 are diagrams illustrating the hybrid drilling approach using the millimeter wave drilling system in operation as described herein.

FIGS. 7-12, and 14 are diagrams illustrating the hybrid drilling approach using the millimeter wave drilling system in operation as described herein. FIG. 7 is a diagram 700 illustrating an initial configuration of the hybrid drilling system described herein. As shown in FIG. 7, the first portion of the borehole 515 can be formed using drill pipe 710, a rotary steerable device 715, and a drill bit 720. The conventional drilling apparatus 505 can direct the drill bit 720 toward the bottom of the borehole 725, and toward the transition region 730 between non-basement rock 520 and basement rock 530. The rotary steerable device 715 is used to maintain the wellbore formation in a straight, vertical line with little or no deviation. Having a vertically straight borehole can minimize the total distance drilled to the target depth 535 and can reduce wear to the drilling apparatus by repeatedly supplying equipment into and out of the rotary drilled borehole 515. In an alternative embodiment, the first portion of the borehole can be reused from a previously operating oil and/or gas well, geothermal well or water well thus reducing the total time to reach the final desired target depth 535.

As further shown in FIG. 7, a distance "Z" is the distance from the bottom of the borehole 725 to the desired target depth 535. The distance Z can be at a maximum at the beginning of the conventional drilling. The initial rate of change of distance Z with respect to time using conventional drilling can be large and can indicate a high rate of penetration in the non-basement rock 520. As conventional drilling progresses to form the first portion of the borehole 515, the distance Z can continue to decrease. Depending on the composition and change of the non-basement rock 520, with respect to depth, the rate of change of distance Z with respect to time can fluctuate. The general trend of the rate of change of distance Z with respect to time can continue to decrease indicative that the rate of penetration can decrease as the borehole is formed to deeper depths.

Figure 8:
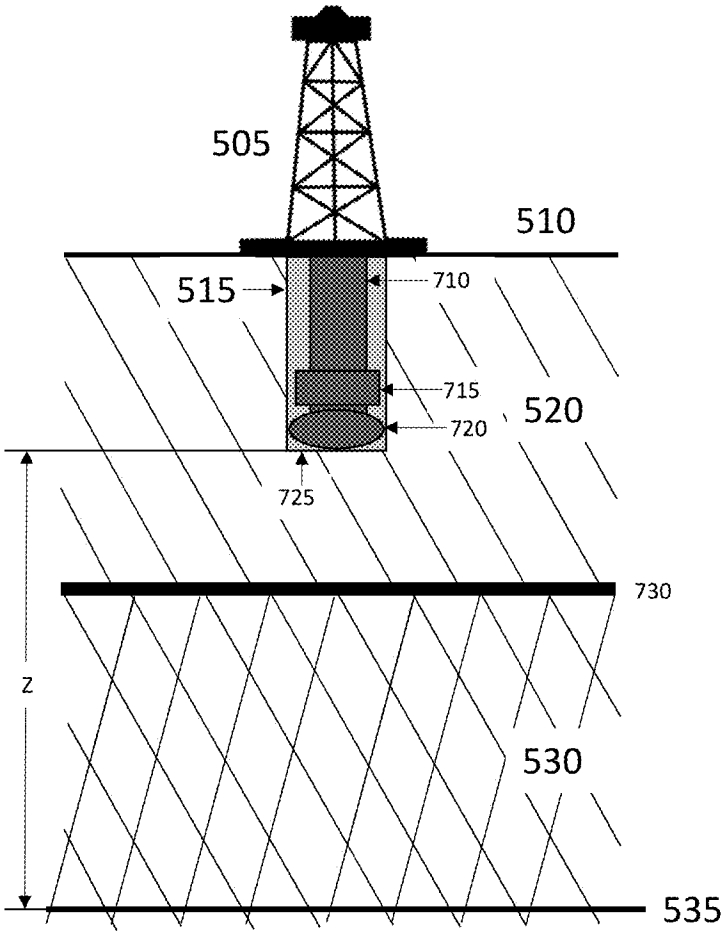

FIG. 8 is a diagram 800 illustrating the deepening of the first portion of borehole 515 using the conventional drilling apparatus while maintaining an acceptable rate of penetration. At some point, typically at the basement rock 530, or the basement rock transition region 730, the rate of penetration will reach a level that is unacceptable, whether mechanically or financially. Additionally, or alternatively, a threshold temperature limit can be reached, which would prevent from drilling deeper via the conventional drilling apparatus.

Figure 9:
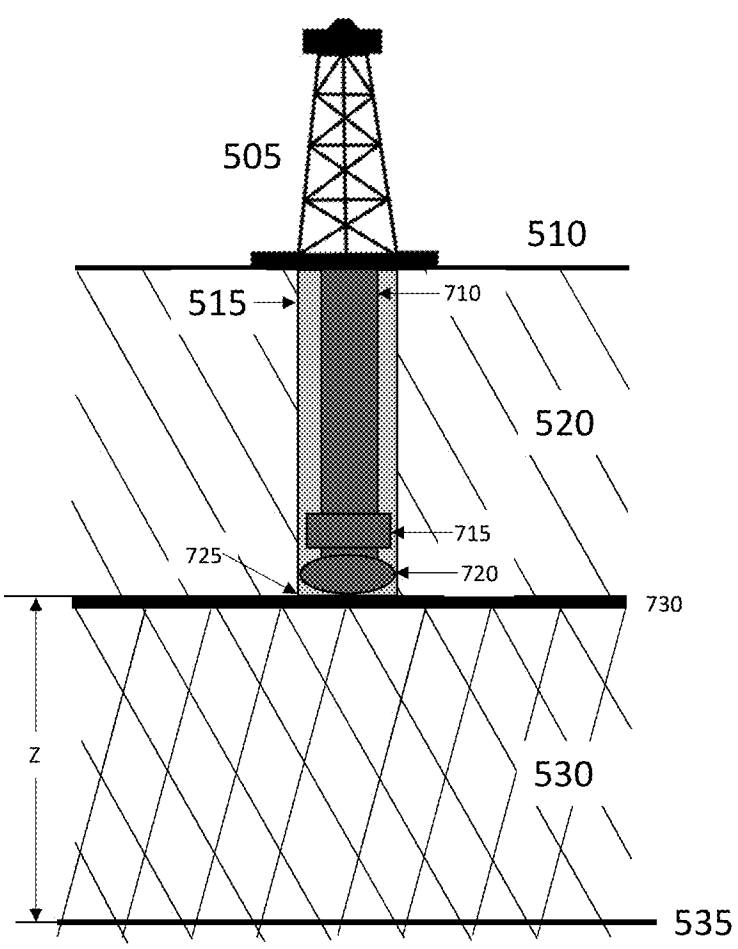

FIG. 9 is a diagram 900 illustrating the conventional drilling apparatus reaching the basement rock transition region 730. As shown in FIG. 9, the conventional drilling apparatus 505 has reached the basement rock transition region 730, at a depth Z from the desired target depth 535. The rate of change of distance Z with respect to time, or the rate of penetration, has become too small to continue with the conventional drilling apparatus 505 used to form the first portion of the borehole 515. Once the basement rock 530 or less permeable rock is reached, or the rate of penetration is slowed significantly with the conventional drilling apparatus 505, it can be determined to utilize a MMWD apparatus to deepen the borehole. Prior to utilizing the MMWD apparatus any fluid should be removed from the borehole 515. In some embodiments, a non-conventional drilling method other than MMWD (e.g., plasma drilling, laser drilling, projectile drilling, electric shock drilling) can be utilized to continue deepening the borehole.

Figure 10:
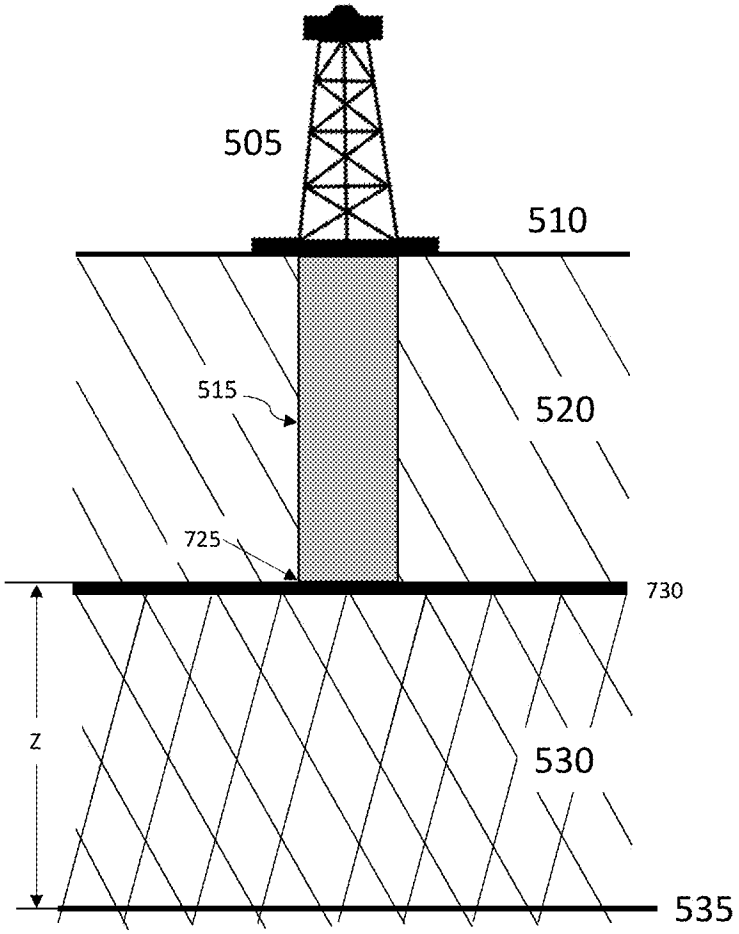

FIG. 10 is a diagram 1000 illustrating completion of the borehole 515 via the conventional drilling apparatus 505. As shown in FIG. 10, the borehole 515 has been formed to the basement rock transition region 730 differentiating non-basement rock 520 and basement rock 530. At this point, casing and cement have been applied into the borehole 515 to ensure stability of the borehole and any remaining liquids left in the borehole 515 removed. In some embodiments, the borehole 515 can be formed beyond the basement rock transition region 730 to extend the borehole 515 beyond discontinuities in the transition region 730 and to ensure a safe transition point to initiate MMWD.

Figure 11:
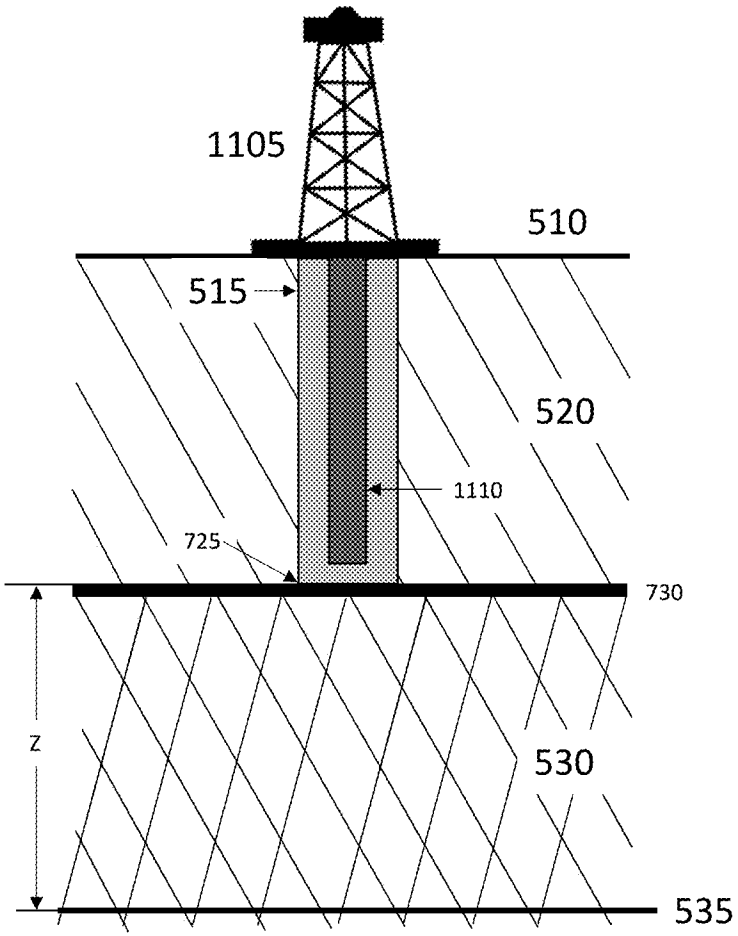

FIG. 11 is a diagram 1100 illustrating initiation of MMWD using a MMWD apparatus 1105. As shown in FIG. 11, the conventional drilling apparatus 505 has been modified and reconfigured as a MMWD apparatus 1105. Implementing the MMWD apparatus 1105 following use of the conventional drilling apparatus 505 can include replacing the liquid (e.g. water-based, oil-based or gas-based) mud system with a gas system compatible with MMWD. A waveguide 1110 have been inserted into the borehole 515. The MMWD of the basement rock 530 can proceed once the waveguide is positioned at or in proximity of the bottom of the borehole 725.

Figure 12:
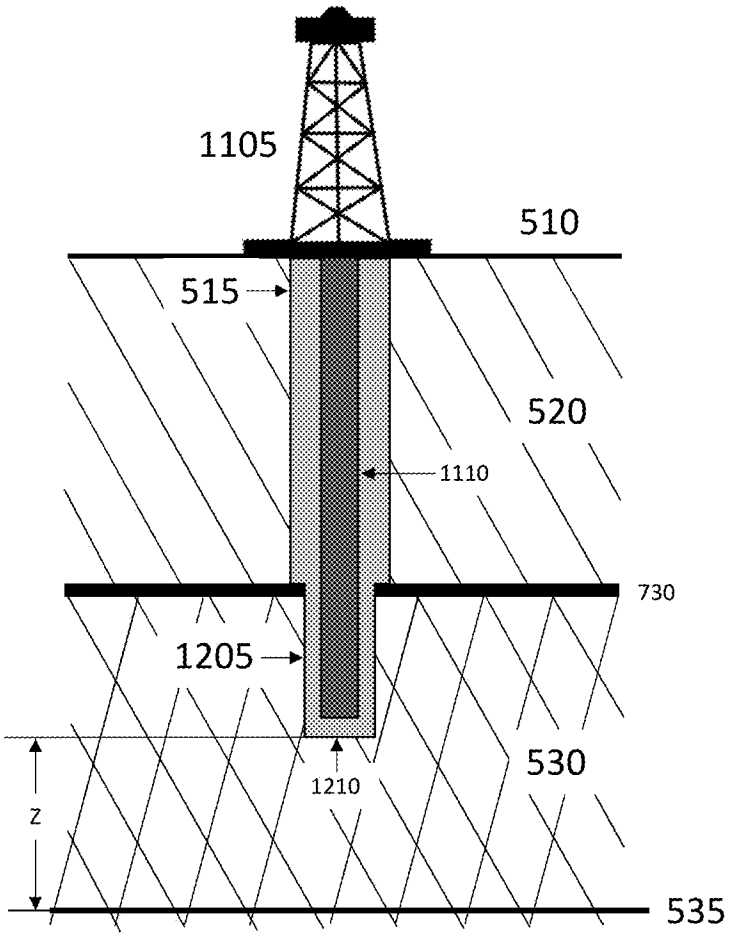

FIG. 12 is a diagram 1200 illustrating formation of borehole 1205 via a thermal melt front 1210 generated via MMWD. In operation, the gyrotron generates and provides radiative energy to melt and vaporize the basement rock 530 to form and advance the thermal melt front 1210. The distance Z will continue to decrease and the effective rate of penetration will be greater than the effective rate of penetration achieved using the conventional drilling apparatus 505.

Figure 13:
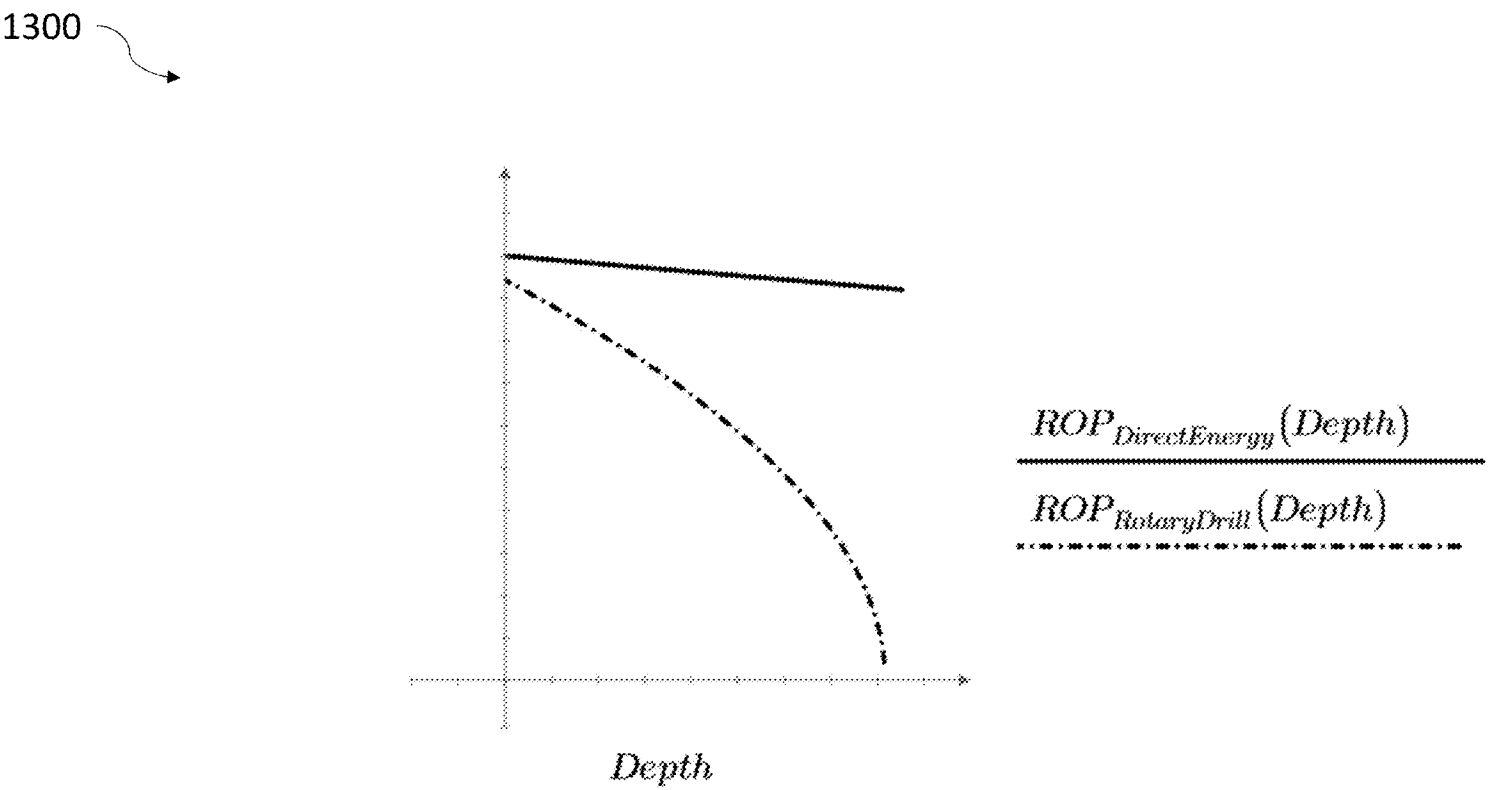
FIG. 13 is a diagram illustrating a plot of a rate of penetration attainable using conventional drilling systems and methods and the millimeter wave drilling system described herein.

FIG. 13 is a diagram illustrating a plot 1300 of a rate of penetration in basement rock 530 attainable using a MMWD apparatus 1105 and methods as compared to the conventional drilling apparatus 505 and methods described herein. As shown in FIG. 13, the rate of penetration using the direct energy, or MMWD apparatus and methods can be maintained at a nearly constant rate and does not decline substantially as a function of depth, as shown for the conventional drilling apparatus and methods. Since there is no direct contact between the MMWD apparatus 1105 with the rock, the EROP is fairly continuous until a target depth is reached. The continuous EROP is beneficially achieved due to the MMWD apparatus 1105 not needing down-time to remove or replace worn out components, such as drill bits and not being significantly affected by rock hardness and/or rock temperature.

Figure 14:
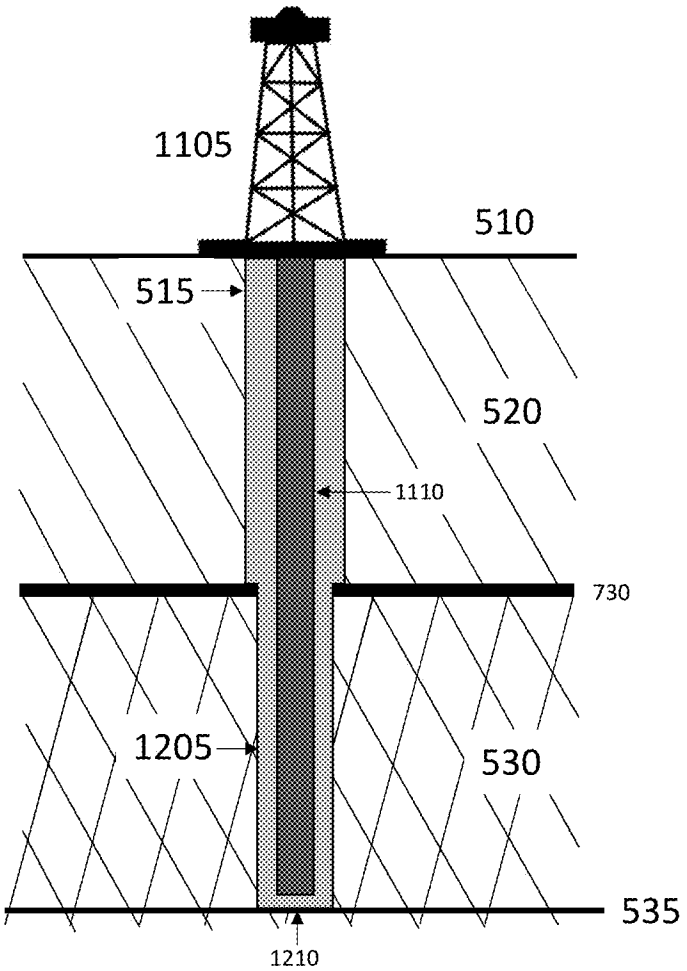

FIG. 14 is a diagram 1400 illustrating completion of the MMWD when the thermal melt front 1210 has reached the target depth 535. Upon reaching the target depth 535, the MMWD apparatus 1105 and the waveguide 1110 can be removed from the borehole 1205 and transported to a next well site for hybrid MMWD formation of additional well boreholes.

In some embodiments, a batch approach can be employed using the hybrid MMWD systems and methods described herein. For example, multiple well boreholes in a given area could be formed using the conventional drilling apparatus and methods prior to changing surface equipment to the MMWD apparatus used to deepen the borehole within the basement rock depths. As a result, time and resources may be saved by performing conventional drilling and MMWD in batches. In other embodiments, the conventional drilling apparatus 505 can be readily modified into a MMWD apparatus 1105 to switchover operations without moving the rig structure.

The improved system, devices, and methods described herein addresses the technical problem of monitoring and controlling the downhole pressure of a well during formation of a borehole of the well using a MMWD approach, such as a MMWD systems and methods described herein. The monitoring and controlling of the downhole pressure of the well can be useful for maintaining stability of the borehole during formation, efficiently operating equipment at well sites and performing well site planning based on geophysical characteristics of the sub-surface formations being accessed rather than operational costs. In this way, the hybrid MMWD system and methods described herein can enable deeper boreholes into less permeable and/or hard rock occurring at higher temperatures below the surface. As a result, deeper deposits of natural and thermal resources can be accessed more efficiently than using conventional drilling apparatus and methods.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

What is claimed is:

1. A system comprising:

a millimeter wave drilling apparatus including a gyrotron configured to inject millimeter wave radiation energy into a borehole of a well via a waveguide configured for insertion into the borehole, the borehole formed via the millimeter wave drilling apparatus and having a downhole pressure monitored at a bottom of the well by at least measuring a pressure of a fluid provided into and/or extracted from the borehole, wherein the downhole pressure is determined using one more of:

the pressure of the fluid provided into the borehole, the pressure of the fluid extracted from the borehole, a downhole pressure determined when forming a portion of the well using a mechanical drilling apparatus including a drill bit, a measure of energy supplied to the millimeter wave drilling apparatus, and a depth of the bottom of the well; and a compressor fluidically coupled to the borehole and configured to control the downhole pressure via a fluid supplied into and/or received from the borehole, wherein the compressor is configured to control the downhole pressure relative to a lithostatic pressure determined for rock surrounding the well at the bottom of the well, wherein the downhole pressure of the well is controlled based on determining a Mach number of the fluid provided into and/or a Mach number of the fluid extracted from the borehole.

2. The system of claim 1, wherein the downhole pressure of the well is controlled based on an inlet mass flow and a back pressure of the compressor.

3. The system of claim 1, wherein the downhole pressure of the well is controlled based on one or more of the pressure of the fluid supplied into the borehole, the pressure of the fluid received from the borehole, a downhole pressure determined when forming a portion of the well using a mechanical drilling apparatus including a drill bit, a measure of energy input supplied to the millimeter wave drilling apparatus, and/or a depth of the bottom of the well.

4. The system of claim 1, wherein the downhole pressure of the well is further controlled based on a physical model associated with one or more of the downhole pressure determined when forming a portion of the well using a drilling apparatus including a drill bit, a measure of energy input supplied to the millimeter wave drilling apparatus, and a depth of the bottom of the well.

5. The system of claim 1, wherein the downhole pressure is controlled to drive particulate matter generated by the millimeter wave drilling apparatus during formation of the borehole into fractures in the rock surrounding the well at the bottom of the well.

6. A system comprising:

at least one data processor; and a memory storing computer-readable instructions, which when executed by the at least one data processor causes the at least one data processor to perform operations including monitoring a downhole pressure of a well during formation of a borehole of the well via a millimeter wave drilling apparatus including a gyrotron configured to inject millimeter wave radiation energy into the borehole via a waveguide configured for insertion into the borehole, the downhole pressure including an amount of pressure present at a bottom of the well, wherein the downhole pressure is monitored by at least measuring a pressure of a fluid provided into and/or extracted from the borehole and the downhole pressure is determined using one or more of:

the pressure of the fluid into the borehole, the pressure of the fluid extracted from the borehole, a downhole pressure determined when forming a portion of the well using a mechanical drilling apparatus including a drill bit, a measure of energy input supplied to the millimeter wave drilling apparatus and a depth of the bottom of the well; and controlling the downhole pressure relative to a lithostatic pressure of rock surrounding the well at the bottom of the well based on operational data associated with a compressor fluidically coupled to the borehole, wherein the downhole pressure of the well is controlled based on determining a Mach number of the fluid provided into and/or a Mach number of the fluid extracted from the borehole.

7. The system of claim 6, wherein the downhole pressure of the well is controlled based on an inlet mass flow and a back pressure of the compressor.

8. The system of claim 6, wherein the downhole pressure of the well is controlled based on one or more of the pressure of the fluid supplied into the borehole, the pressure of the fluid received from the borehole, a downhole pressure determined when forming a portion of the well using a drilling apparatus including a drill bit, a measure of energy input supplied to the millimeter wave drilling apparatus, and/or a depth of the bottom of the well.

9. The system of claim 6, wherein the downhole pressure of the well is further controlled based on a physical model associated with one or more of the downhole pressure determined when forming a portion of the well using a drilling apparatus including a drill bit, a measure of energy input supplied to the millimeter wave drilling apparatus, and a depth of the bottom of the well.

10. The system of claim 6, wherein the downhole pressure is controlled to drive particulate matter generated by the millimeter wave drilling apparatus during formation of the borehole into fractures in the rock surrounding the well at the bottom of the well.

* * * * *